United States Patent [19]

Albishausen

[11] 4,137,600

[45] Feb. 6, 1979

[54] CLEANING APPARATUS

[76] Inventor: Hartmut Albishausen, Auf den 30 Morgen, Friedrichsdorf, Fed. Rep. of Germany

[21] Appl. No.: 861,637

[22] Filed: Dec. 19, 1977

Related U.S. Application Data

[63] Continuation-in-part of Ser. No. 723,195, Sep. 14, 1976, Pat. No. 4,073,030.

[30] Foreign Application Priority Data

| | | | |
|---|---|---|---|
| Sep. 15, 1975 | [AT] | Austria | 7052/75 |
| Sep. 15, 1976 | [BE] | Belgium | 846242 |
| Sep. 10, 1976 | [BR] | Brazil | 7605980 |
| Sep. 14, 1976 | [CA] | Canada | 261184 |
| Sep. 14, 1976 | [DK] | Denmark | 4144/76 |
| Sep. 10, 1976 | [DE] | Fed. Rep. of Germany | 2640697 |
| Sep. 14, 1976 | [FR] | France | 76 27545 |
| Sep. 14, 1976 | [IE] | Ireland | 2048/76 |
| Sep. 14, 1976 | [IT] | Italy | 69234 A/76 |
| Sep. 14, 1976 | [LU] | Luxembourg | 75791 |
| Sep. 15, 1976 | [NL] | Netherlands | 76-10269 |
| Sep. 14, 1976 | [SE] | Sweden | 7610156 |
| Sep. 9, 1976 | [CH] | Switzerland | 11474/76 |
| Sep. 8, 1976 | [GB] | United Kingdom | 37246/76 |

[51] Int. Cl.[2] ..... A47L 7/00

[52] U.S. Cl. ..... 15/322

[58] Field of Search ..... 15/320, 321, 322

[56] References Cited

U.S. PATENT DOCUMENTS

| | | | |
|---|---|---|---|
| 742,880 | 11/1903 | Lotz | 15/322 |
| 2,692,163 | 10/1954 | Geel | 15/320 X |
| 3,705,437 | 12/1972 | Rukavina et al. | 15/322 X |
| 3,840,935 | 10/1974 | Fitzgerald et al. | 15/322 |
| 3,942,214 | 3/1976 | Maasberg | 15/320 |

*Primary Examiner*—Christopher K. Moore
*Attorney, Agent, or Firm*—Michael J. Striker

[57] ABSTRACT

A vacuum-type cleaning apparatus employs a cleaning head which has an intake opening that is adapted to be juxtaposed with contaminated portions of an object to be cleaned. Air is withdrawn from the interior of the cleaning head. Nozzles inject streams of cleaning fluid into the channel and the flow of the fluid is directed towards the intake opening and at an angle relative to the plane of the intake opening for the fluid to impinge the object and to be subsequently removed from the object by suction together with contaminants entrained therein at a wet cleaning zone. The flow is directed and changed into a liquid curtain by a baffle which is inclined transversely of the plane of the intake opening, preferably at an acute angle. The baffle is movably mounted within the channel and provides for a dry cleaning zone in which loose contaminant particles are being picked up from a region of the surface prior to contacting of such regions by the curtain of cleaning fluid in the wet cleaning zone, the sizes of the cleaning zones being variable by moving the baffle.

15 Claims, 9 Drawing Figures

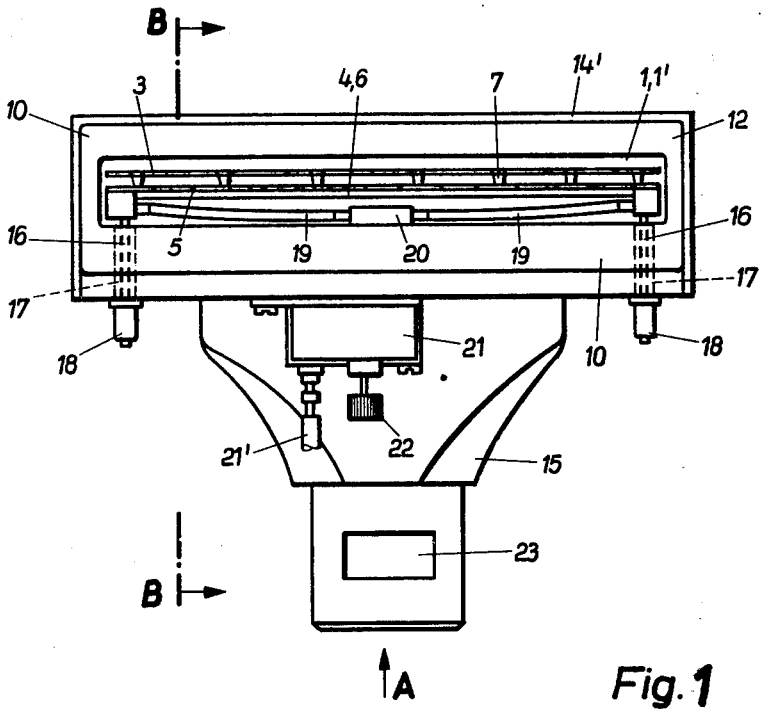
Fig. 1
Fig. 2
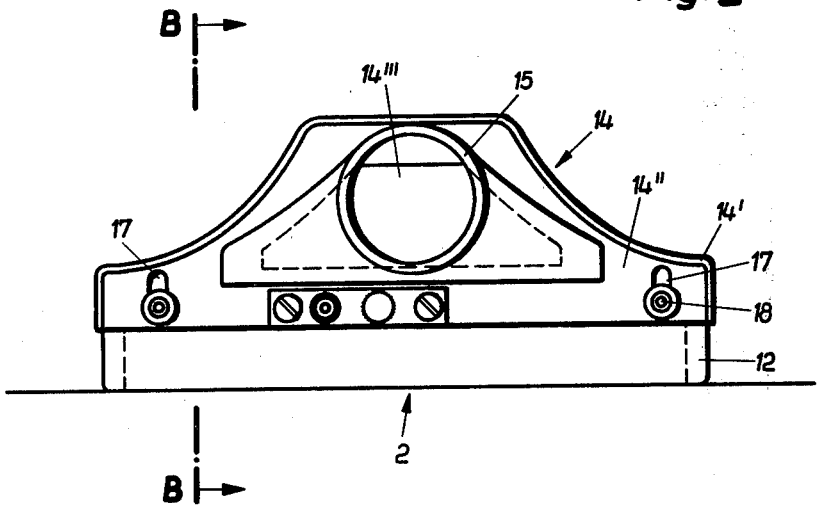

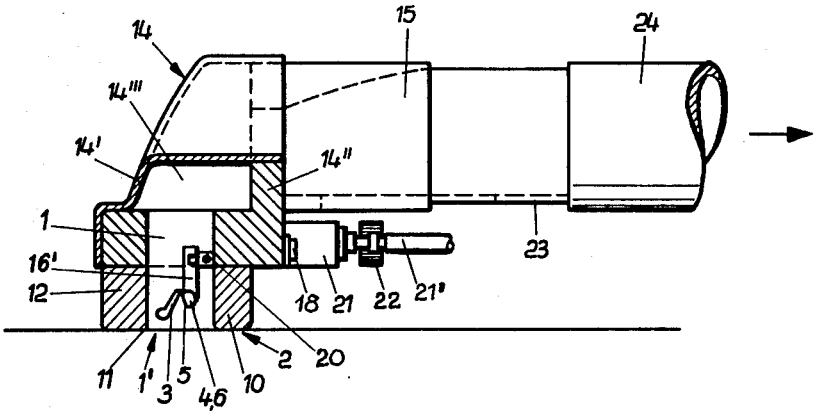
Fig. 3
Fig. 4
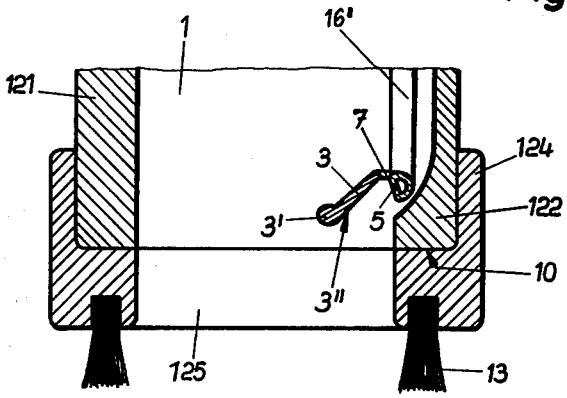
Fig. 5
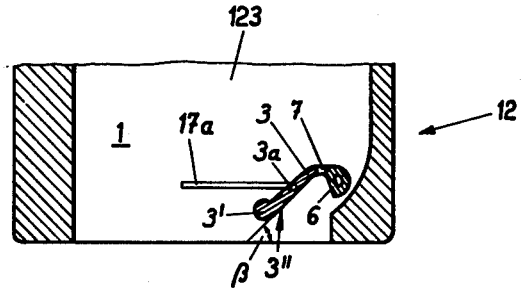

Fig. 6c
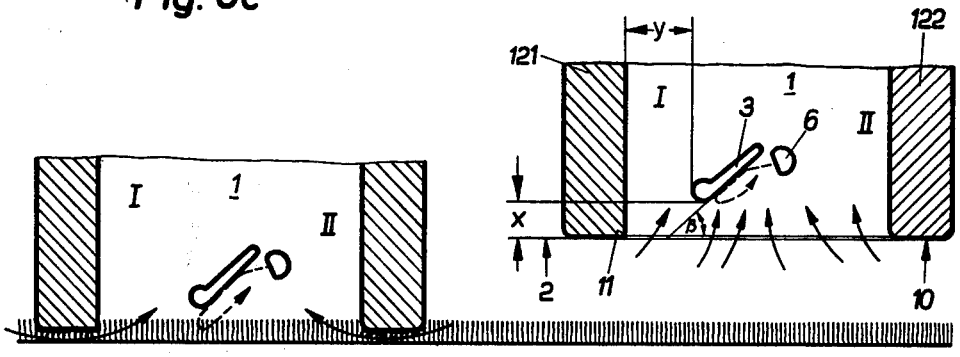
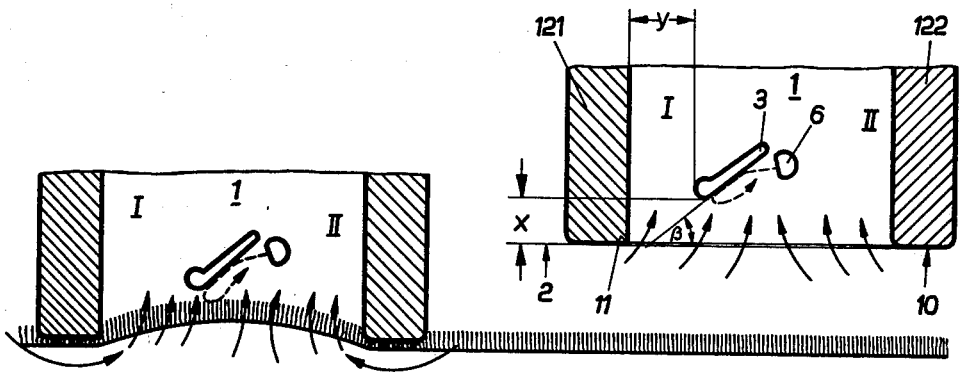
Fig. 6d

CLEANING APPARATUS

CROSS-REFERENCE TO RELATED APPLICATIONS

This application is a continuation-in-part of my earlier application Ser. No. 723,195, filed on Sept. 14, 1976, now U.S. Pat. No. 4,073,030.

BACKGROUND OF THE INVENTION

The present invention generally relates to a cleaning aparatus and to a method of cleaning and, more particularly, to vacuum-type cleaners which apply a cleaning fluid containing a liquid component and a detergent component to the object to be cleaned and which subsequently remove the cleaning fluid together with the entrained contaminants.

Various constructions of cleaning apparatuses for cleaning furniture, rugs and analogous textile material objects are already known. An apparatus of this kind usually includes a cleaning head having an intake opening which is in communication with a suction channel and which is adapted to be juxtaposed with a contaminant-bearing object to be cleaned, and such apparatus often also includes nozzles which spray a pressurized stream of cleaning fluid directly onto the object. However, such an apparatus has the disadvantage that the pressurized stream is directed normally through the plane of the intake opening so that the stream actually tends to force the contaminant or dirt particles contained in the upper regions of the object even deeper into the interstices of the base web. The dirt particles thereby tend to become anchored and accumulate in the fabric material, thus making subsequent cleaning operations necessary. Such additional cleaning operations are disadvantageous because they are costly and increase the wear of the fabric by subjecting the fabric for longer periods of time to higher suction forces which are now required to remove the more deeply embedded dirt, and by more frequently exposing the fabric to the chemical action of the chemical detergent agents.

The prior art also has the disadvantage that the cleaning liquid is applied to an object to be cleaned at points, or in strips when the cleaning head is moving along the objects, i.e, it is applied non-uniformly. In oder to achieve uniform wet cleaning over the whole surface of the respective object, the cleaning head has to be moved several times over the same area of the object.

The prior art also has the disadvantage that, when the cleaning head is lifted from a respective contaminated portion of an object or when the cleaning head is applied only partially to an object, the cleaning fluid tends to drip down onto the object through the intake opening. This situation is evidently disadvantageous and has been heretofore solved only in an unsatisfactory manner by requiring an operator to repeatedly turn off the supply of cleaning fluid prior to lifting the cleaning head from one location and moving the same to another location.

Another cleaning head for cleaning surfaces of carpets includes a suction cap connected to a generator of subatmospheric pressure and also includes a series of nozzles, the outlets of which have small areas and are aimed directly onto the surface of the carpet or onto the plane of application of the cleaning head, which is defined by a rim of the suction cap. The nozzles are connected via a supply duct to an aerated cleaning fluid reservoir, the cleaning fluid leaving the outlets only when drawn out of the same by the subatmospheric pressure that then exists in the suction cap. In this way loss or dripping of the cleaning fluid is avoided, during a partial application of the cleaning head to, or when the cleaning head is lifted from, the carpet. However, disadvantages of this arrangement are that the quantity of fluid that can be emitted by the nozzles per unit of time and hence the depth of penetration of the cleaning fluid into the carpet are limited, and it is practically impossible to work with the cleaning head above the level of fluid in the fluid reservoir, as for example when it is desired to clean curtains, wall coverings or the like. The range of use of the cleaning head is therefore restricted as regards the materials which can be cleaned, and the cleaning effect is also limited. The cleaning of an object is strictly limited to the upper surface regions. Deeply embedded dirt cannot be effectively picked up.

SUMMARY OF THE INVENTION

Accordingly, it is an object of the present invention to overcome the disadvantages of the prior art.

Another object of the present invention is to provide a cleaning apparatus which renders it possible to uniformly apply cleaning fluid to the objects to be cleaned and to reliably and effectively remove contaminants including deeply embedded dirt particles from such objects, such as textile materials.

Another object of the present invention is to prevent dripping of the cleaning fluid when the cleaning apparatus is lifted from the object being cleaned without having to interrupt the cleaning fluid stream.

In keeping with these objects and others which will become more apparent hereinafter, one feature of the invention resides in a cleaning arrangement of the type having a suction source and a cleaning fluid source, briefly stated, in a combination comprising a movable cleaning head including a suction attachment connected to the suction source, an elongated intake opening lying in a plane and juxtaposed with contaminated portions of a surface to be cleaned during normal use, and a suction channel extending intermediate said suction attachment and said intake opening and operative for conveying flowable media from the contaminated surface portions being cleaned to the suction source; means for injecting streams of cleaning fluid in respective paths into said suction channel including a plurality of fluid discharge outlets in said suction channel, said oulets communicating with the cleaning fluid source and being spaced along a row which extends generally along the elongation of said intake opening; means for directing the respective streams in the form of a fluid curtain towards said intake opening at a predetermined acute cleaning angle relative to the plane of said intake opening, including a baffle in said suction channel, said baffle being spaced from said outlets and extending generally along the row of said outlets, said baffle having a fluid-deflecting surface which is located in the paths of the respective streams for intercepting the latter and which is inclined at said predetermined cleaning angle for merging the intercepted streams into the fluid curtain and for directing the latter towards said intake opening during normal use to thereby subdivide said suction channel into a dry-cleaning zone in which substantially only loose contaminants are removed from the contaminated surface portions being cleaned, and a wet-cleaning zone in which contaminants released from the contaminated surface portion by the cleaning fluid are removed together with the latter; and means for adjusting the size of said dry-cleaning zone relative to said wet-cleaning zone, including adjusting members operatively connected to said baffle and mounting the same on said cleaning head for adjustable arresting in any of a plurality of positions relative to said suction channel. The adjusting means is advantageously so configurated as to maintain said fluid-deflecting surface of said baffle at said predetermined cleaning angle during the adjustment of said baffle between said positions thereof.

Both the rate of flow of the cleaning fluid and the magnitude of the suction are adjustable so that an operating condition is obtained wherein the cleaning fluid continuously penetrates to a certain desired depth into the textile material when the cleaning head contacts the object to be cleaned, and wherein the cleaning fluid is continuously turned back prior to reaching the intake opening when the cleaning head is lifted from the object to be cleaned. This feature assures that the stream of cleaning fluid may be continuously ejected from the nozzles to be continuously and automatically routed towards the suction-generating unit regardless of the degree of contact of the cleaning head with the object being cleaned. An operator no longer has to shut off the cleaning fluid stream during operation. The baffle establishes a uniform so-called liquid curtain and serves to stabilize and to better control the flow towards and away from the intake opening.

In accordance with another feature of the invention, the baffle is mounted within the suction channel and defines dry- and wet-cleaning zones therein. The dry-cleaning zone is essentially that region of the intake opening which relies solely on suction to pick up loose particles, whereas the wet cleaning zone is that region of the intake opening which utilizes the suction to pick up the contaminant-entrained cleaning fluid. The position of the baffle in the suction channel, the rate of flow of the cleaning fluid stream and the magnitude of the suction are all variables which are adjustable depending upon the particular requirements such as the degree of cleaning desired or the nature of the object to be cleaned.

The suction in the channel should be so adjusted that no undue energy need be expended by an operator to press the cleaning head down on the portion of the object to be cleaned. The operator thus need only exert such forces on the cleaning apparatus which are necesary to obtain to-and-fro movement of the cleaning head during the use of the cleaning apparatus.

An important feature of the invention is the adjustability of the position of the baffle in the suction channel. For most practical applications only an adjustment of the vertical distance of the baffle relative to the plane of the intake opening is necessary. However, the present invention also contemplates the adjustment of the horizontal distance of the baffle relative to the wall portions bounding the intake opening, as well as the adjustment of the angle of inclination of the baffle relative to the aforementioned plane.

Yet another feature resides in arranging the nozzles in a linear row so that all of the nozzle openings face the baffle and the streams issuing therefrom impinge on the underside of the baffle at an angle. This feature achieves a continuous water curtain of uniform thickness and also having laminar flow conditions. An especially advantageoous construction is obtained if the nozzle openings are all linearly arranged along a flattened section of a thick-walled tubular pipe so that all of the nozzle openings will be aimed on the underside of the baffle, enclosing an angle therewith. This construction greatly simplifies the interchange of the nozzle with other nozzle arrangements.

To even further facilitate the interchange and maintenane of the component parts of the cleaning apparatus, the tubular pipe containing the nozzle openings and the baffle are interconnected by webs spaced along the respective elongations of the pipe and baffle. Such subassemblies can be interchanged with different ones at will.

An additional feature of the invention resides in providing the baffle with an enlarged, teardrop-shaped free end portion which faces away from the nozzles. This smooth contour facilitates the wrapping around of the cleaning fluid stream which is thus directed away from the plane of the intake opening, as well as averts any otherwise possible damage to the object being cleaned in the event that the material of the object actually enters the intake opening by virtue of the suction existing thereat.

Another feature of the invention resides in forming the suction channel in a slot-shaped configuration, and in providing a shear edge at one side of the slot. This feature permits a squeegee-type action during the to-and-fro movement of the cleaning head for the removal of excess moisture.

It is advantageous to form the cleaning head out of any synthetic plastic material, tetrafluoroethylene being especially preferred for its wear resistance and sliding properties.

The novel features which are considered as characteristic for the invention are set forth in particular in the appended claims. The invention iself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a bottom plan view of the cleaning apparatus taken in direction from the object to be cleaned;

FIG. 2 is a side view of the cleaning apparatus taken in direction of the arrow A of FIG. 1;

FIG. 3 is a partially sectioned view of the cleaning apparatus taken along the line B—B in FIGS. 1 or 2;

FIG. 4 is an enlarged, partially sectioned view of a detail of FIG. 3 with a brush attachment;

FIG. 5 is an enlarged modified sectional view of a detail of FIG. 3; and

DESCRIPTION OF THE PREFERRED EMBODIMENTS

Figure 6A:
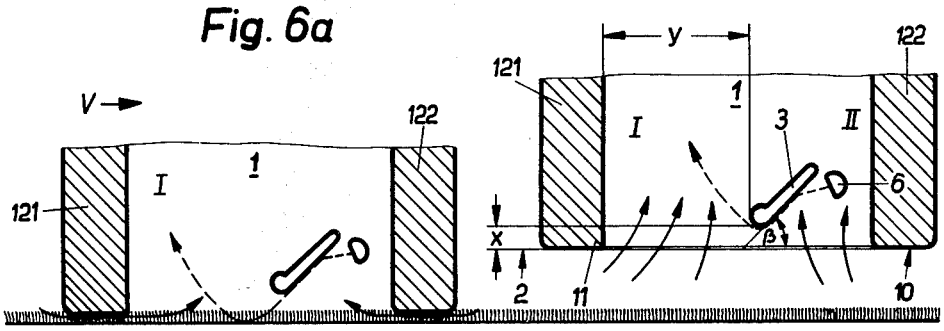
FIGS. 6*a, b, c* and *d* are partially diagrammatic views of preferred embodiments of the invention each depicting the operation of the cleaning apparatus at different operational conditions.

Discussing jointly the apparatus and method of the invention with respect to FIGS. 1–3 of the drawing, it will be seen that the cleaning apparatus is comprised of a movable housing having a cleaning head or contact portion 12. The head 12 has an intake opening 1′ bounded by wall portions 10 which lie in a plane 2 that is intended to be juxtaposed with contaminated portions of an object to be cleaned.

The cleaning apparatus also includes a suction-generating unit which comprises an elongated suction channel 1 which extends to the opening 1′, a suction hood 14 which overlies the head 12, a conduit 24, and a hollow support attachment 15 which connects the hood 14 to the conduit 24. The hood 14 has an upper part 14' and a lower part 14" which together bound an interior space 14"' which is in communication with the channel 1 and with the interior of the hollow support attachment 15. Conduit 24 is connected for operation, to a suction-generator unit which is conventional in the art of vacuum cleaners and thus has been omitted from the drawing. Such unit draws air successively through the intake opening 1', the channel 1, the interior space 14"' of the hood 14, the interior of the attachment 15, and the conduit 24. An opening 23 is formed in the conduit 24 and/or in the attachment 15. If desired, the opening 23 can be partially or completely covered, thereby adjusting the magnitude of the suction force.

The channel 1 is preferably formed in the configuration of an elongated slot which extends across the width of the apparatus. One boundary wall of the slot-shaped channel 1, specifically the trailing wall as considered with reference to the direction of travel of the cleaning apparatus relative to the object to be cleaned, is formed with a shear edge 11 which enhances the cleaning effect.

A stream of cleaning fluid medium containing a carrier medium and possibly also a cleaning component such as detergent agents, disinfectants and the like, is injected into the channel 1 preferably near the opening 1' by at least one and preferably a plurality of nozzles 6 which are mounted in the channel 1. Each nozzle 6 has an opening 5 which faces in a preferred embodiment generally towards the plane 2 of opening 1'. All of the nozzles 6 are arranged in a longitudinally extending row along a tubular pipe 4. At both ends of the pipe 4, connecting tubular members 19 establish communication between the interior of the pipe 4 and a distributing member 20. The distributing member 20 is in turn connected with a control chamber 21 which is in its turn connected to a supply of cleaning fluid medium by a connector 21'. Thus the cleaning fluid medium is conducted, preferably under pressure, through the connector 21', the chamber 21, the distributing member 20, the tubular members 19, and the pipe 4 for eventual discharge as a pressurized stream from the nozzles 6 into the channel 1. An adjusting screw element 22 is operative for setting the amount and pressure of the cleaning fluid medium flow.

This stream is intercepted and directed by a baffle element 3 which is also mounted in the channel 1 at a distance from the nozzles 6. The baffle 3 is elongated and extends across the width of the apparatus, and is inclined at an angle relative to the plane 2 of the opening 1'. As shown in FIG. 4, the baffle 3 has a deflecting or lower side 3" and an enlarged, preferably teardrop-shaped free end 3' which faces away from the nozzles 6. The baffle 3 is operative to cause the stream to be directed toward and beyond the plane 2 of the opening 1' for the stream to impinge upon any contaminated portions of an object to be cleaned and dislodge contaminants therefrom.

The relative and/or absolute position of the nozzles 6 or the baffle 3 in the channel 1 may be either independently or simultaneously adjusted. Moreover, the nozzles 6 and the baffle 3 may be permanently locked in position relative to each other. In FIGS. 1 to 4 the position of the baffle 3 relative to the nozzles 6 is fixed due to the fact that webs 7 are provided which interconnect the baffle 3 and the nozzles 6. Thus, the angle of incidence of the stream on the baffle 3 is predetermined in this embodiment.

The absolute position of both the baffle 3 and the nozzles 6 relative to the plane 2 can be simultaneously adjusted as illustrated in FIGS. 1 and 2, by the provision of support rods 16 which extend outwardly through slotted holes 17, 17' to the exterior of the housing. The slotted holes 17, 17' extend generally in direction transverse to the plane 2 and permit vertical adjustment as desired relative to the latter by turning the nuts 18 in requisite direction.

In FIG. 3 the support rods 16 are connected via holders 16' to the nozzles 6 which are arranged along the pipe 4.

If it is desired to change the predetermined angle of incidence in this embodiment, the entire interconnected subassembly of nozzles 6, webs 7 and baffle 3 can be replaced as a unit by another similar assembly which has a different angle of incidence. In the operation of the embodiment of FIGS. 1–3, the respective rates for supplying and withdrawing the cleaning fluid medium are separately adjustable so that proper balancing between the two rates is obtained.

In operation, i.e. while moving on and in contact with the object to be cleaned, the cleaning apparatus which is connected with a vacuum generator via the conduit 24, e.g. a tubular pipe, and with a source of pressure fluid, e.g. a pump, via the connector 21', may either be held in the hand and guided directly in the region of the attachment 15, which may be formed as a handle, or may be moved indirectly via a guide rod attached in the vicinity of the attachment 15.

FIG. 4 illustrates a lower portion of the cleaning head 12 which is comprised of front and rear sections 121 and 122. A brush attachment 124 is placed over the free end of the head 12 so that a passage 125 is aligned with the channel 1. A row of brushes 13, preferably arranged in an annular configuration, is mounted at the underside of the attachment 124 at a border region which overlies the wall portions 10. A quick and simple interchange of the attachment 124 with other attachments on the head 12 is realized by snap-in and snap-out connection.

In FIG. 5, the baffle 3, which is illustrated as being again connected to the nozzles 6 by the webs 7, is mounted for displacement relative to the head 12 within the channel 1 in elongated slots 17*a* provided in lateral walls 123 of the head 12, by pivots 3*a* in a manner which is, for instance, similar to that discussed above in connection with the mounting of the support rods 16 in the slotted holes 17, 17'. As illustrated, the slot 17*a* extends horizontally, but it is to be understood that the slot 17*a* could also extend at any angle to the horizontal, either over its entire length, or at different angles at different sections thereof. The particular shape of the slot 17*a* will depend on the desired adjustment movement of the baffle-nozzle sub-assembly 3, 6. When desired, the pivot 3*a* could have a noncircular configuration so that, when received in a straight slot 17*a*, the pivot 3*a* will maintain the baffle 3 at an angle $\beta$ relative to the horizontal in all adjusted positions of the sub-assembly 3, 6. It is also proposed by the present invention that the nozzles 6, instead of being adjustable with the baffle 3, be adjustable independently thereof, but in a similar manner.

Turning now to FIGS. 6*a*, *b*, *c* and *d*, it will be seen that the operation of the cleaning apparatus is diagrammatically illustrated with like reference numerals identifying like components. The left side of each of these Figures shows the operational condition in which the cleaning head 12 comprised of front and rear sections 121 and 122 is placed in direct contact with the object to be cleaned; the right side of each of the FIGS. 6a to 6d shows a different operational condition in which the cleaning head has been lifted a slight distance from the object. As an aid in understanding all of these Figures, it is mentioned that the solid line arrows indicate air flow, whereas the dashed line arrows indicate the flow of the stream of cleaning fluid medium through the apparatus. The direction of travel of the movable housing has been identified by an arrow V. It will be remembered that the shear edge 11 which facilitates the cleaning is formed on the trailing or rear section 121. Furthermore, in each of the FIGS. 6a to 6d, the absolute positions of the baffle 3 and the nozzles 6 relative to the plane 2 and the channel 1 are different. Thus, the reference character y identifies the distance of the enlarged end 3' of the baffle 3 from the inner surface of the trailing section 121; the reference character x identifies the distance of the enlarged end 3' of the baffle 3 from the plane 2; and reference character $\beta$ identifies the angle of inclination that the baffle 3 assumes relative to the plane 2. The angle $\beta$ is preferably an acute angle, 45° being the preferred value. The baffle 3 subdivides the channel 1 into chambers I and II. The chamber I generally is the region adjacent the trailing side section 121; and the chamber II generally is the region adjacent the leading side section 122.

The object to be cleaned in FIG. 6a is preferably a low nap or pile rug whose underside is firmly secured, e.g. adhesively, to the floor or analogous support. Thus, movement of the cleaning head 12 across the rug will not result in any appreciable attraction of a respective rug portion into the intake opening. The x, y, $\beta$ dimensions of the baffle 3 are selected as indicated so that, in the so-called "contact" condition illustrated on the left side of FIG. 6a, the continuous stream of cleaning fluid, aided by the incoming air, successively impinges on the baffle 3, flows along the underside of the baffle 3, continuously impinges on the rug, penetrates in the nap of the rug wherein it picks up the contaminants, and is finally removed by suction in direction away from the plane 2 towards the area of the chamber I. In the so-called "lifted" condition on the right side of FIG. 6a, the force of the incoming air forces the flow of the cleaning fluid closely around the enlarged ends 3'. Thus any dripping of the cleaning fluid onto the rug is prevented.

By moving the head 12 in the direction of the arrow V, incoming air flowing under the leading side section 122 sucks up any contaminants in the region of the rug located immediately ahead of the baffle 3. In other words, any dirt particles not anchored in the rug region get initially sucked up into chamber II before the cleaning fluid contacts this rug region. This feature greatly facilitates the overall cleaning operation.

Figure 6B:
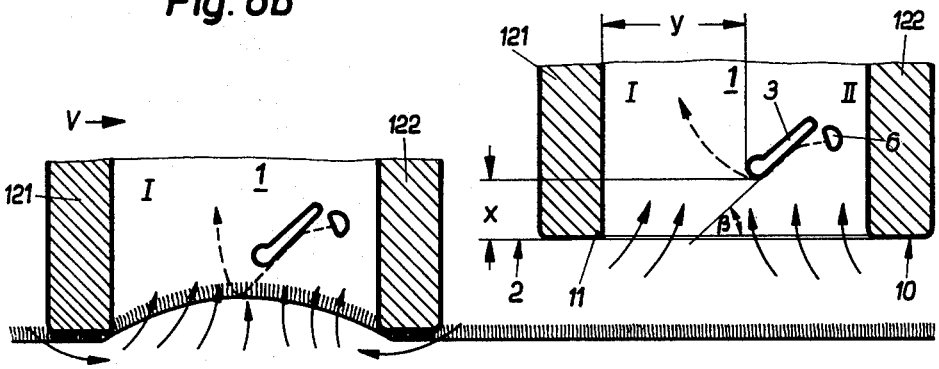

The object to be cleaned in FIG. 6b is any air-permeable textile material, preferably a pillow cushion covered with relatively short fibers such as felt, whose underside is not firmly secured to any support. Thus, the suction force will attract the respective textile material portion into the intake opening as shown in FIG. 6b. The x dimension of the baffle 3 is herein selected to be greater than the corresponding x dimension of FIG. 6a in order to accommodate the entry of the respective textile material portion. In this particular application, the rounded smooth edge of enlarged portion 3' of the baffle 3 assures that no damaging contact, if any, will be made with the textile material during use. Otherwise, the operation depicted in FIG. 6b is essentially similar to that described above. However, the intensity of the cleaning effect in the object to be cleaned in FIG. 6b is greater in this case because additional air comes from underneath the object and actually penetrates through the foramina of the textile material.

The object to be cleaned in FIG. 6c is preferably a high nap or pile rug whose underside is firmly, e.g. adhesively secured to the floor or analogous support. In this embodiment the dimension y is chosen to be smaller than the same dimension in FIGS. 6a and 6b. Thus, the amount of the incoming air flowing under the leading side section 122 is greater than that of the air flowing under the trailing side section 121. This difference in the air flow shapes the stream of cleaning fluid so that it now successively impinges on the baffle 3, flows along the underside 3'' of the baffle 3, continuously impinges on the rug, penetrates the nap, and is finally removed by suction in direction away from the plane 2 towards the area of the chamber II. In the lifted condition, the incoming air flow forces the cleaning fluid flow closely about the baffle 3 and toward the nozzles 6. Therefore, dripping of the cleaning fluid onto the rug is prevented in this condition.

The arrangement of FIG. 6c has a larger dry cleaning chamber II than the dry cleaning chamber II of FIGS. 6a or 6b. This dry cleaning chamber II takes up the larger portion of the total volume of the chambers I and II. Thus, the correspondingly much smaller wet-cleaning chamber I means that the arrangement of FIG. 6c is especially well suited for a requirement where only a partial cleaning of the object to be cleaned is required.

The object to be cleaned in FIG. 6d is preferably an air-permeable textile material, preferably a pillow cushion covered with relatively long fibers, whose underside is not firmly secured to a support. This illustrated arrangement is especially well suited for a partial cleaning requirement. The dimension x is smaller than the corresponding x dimension of FIG. 6b, but is larger than that of FIG. 6c. The dimension y is also smaller than the corresponding y dimension of FIG. 6b. As described above in connection with FIG. 6c, the cleaning fluid medium flow is directed back towards the nozzle 6 after contact has been made with the object. The wet cleaning chamber I is again relatively much smaller than the dry cleaning chamber II. The required magnitude of the suction source needed in this arrangement is relatively much less than that used in connection with impermeable fabrics for the reason that additional air enters through the foramina of the textile material itself.

It will be understood that each of the elements described above, or two or more together, may also find a useful application in other types of constructions differing from the types described above.

While the invention has been illustrated and described as embodied in a cleaning apparatus and method of cleaning, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a cleaning arrangement of the type having a suction source and a cleaning fluid source, a combination comprising a movable cleaning head including a suction attachment connected to the suction source, an elongated intake opening lying in a plane and juxtaposed with contaminated portions of a surface to be cleaned during normal use, and a suction channel extending intermediate said suction attachment and said intake opening and operative for conveying flowable media from the contaminated surface portions being cleaned to the suction source; means for injecting streams of cleaning fluid in respective paths into said suction channel, including a plurality of fluid discharge outlets in said suction channel, said outlets communicating with the cleaning fluid source and being spaced along a row which extends generally along the elongation of said intake opening; means for directing the respective streams in the form of a fluid curtain towards said intake opening at a predetermined acute cleaning angle relative to the plane of said intake opening, including a baffle in said suction channel, said baffle being spaced from said outlets and extending generally along the row of said outlets, said baffle having a fluid-deflecting surface which is located in the paths of the respective streams for intercepting the latter and which is inclined at said predetermined cleaning angle for merging the intercepted stream into the fluid curtain and for directing the latter towards said intake opening during normal use to thereby subdivide said suction channel into a dry-cleaning zone in which substantially only loose contaminants are removed from the contaminated surface portions being cleaned, and a wet-cleaning zone in which contaminants released from the contaminated surface portions by the cleaning fluid are removed together with the latter; and means for adjusting the size of said dry-cleaning zone relative to said wet-cleaning zone, including adjusting members operatively connected to said baffle and mounting the same on said cleaning head for adjustable arresting in any of a plurality of positions relative to said suction channel.

2. A cleaning apparatus as defined in claim 1, wherein said adjusting means is so configurated as to maintain said fluid-deflecting surface of said baffle at said predetermined cleaning angle during the adjustment of said baffle between said positions thereof.

3. A cleaning apparatus as defined in claim 1, wherein said injecting means comprises a plurality of nozzles mounted in said suction channel and having said outlets which open into the plane of said intake opening.

4. A cleaning apparatus as defined in claim 3, wherein said baffle is spaced at a distance from the plane of said intake opening, and wherein said adjusting means is operative for adjusting said distance.

5. A cleaning apparatus as defined in claim 3, wherein said outlets are so arranged that the streams injected therethrough into said channel impinge said fluid-deflecting surface of said baffle at an acute angle.

6. A cleaning apparatus as defined in claim 1, wherein said injecting means comprises an elongated pipe having said outlets distributed therealong.

7. A cleaning apparatus as defined in claim 6, wherein said pipe has a flattened side wall on which said outlets are located.

8. A cleaning apparatus as defined in claim 1; and further comprising means for interconnecting said injecting means and said baffle so that said injecting means and baffle form a replaceable unit.

9. A cleaning apparatus as defined in claim 8, wherein said unit is spaced at a distance from said plane, and wherein said adjusting means is operative for adjusting said distance.

10. A cleaning apparatus as defined in claim 1, wherein said baffle has an enlarged rounded portion spaced from the plane of said intake opening.

11. A cleaning apparatus as defined in claim 10, wherein said enlarged portion is of teardrop-shaped configuration and extends in direction away from said injecting means.

12. A cleaning apparatus as defined in claim 1, wherein said suction channel is of slot-shaped configuration.

13. A cleaning apparatus as defined in claim 12, wherein said slot-shaped channel has front and rear walls, one of said walls being formed with a shear edge.

14. A cleaning apparatus as defined in claim 1; and further comprising an accessory brush component mounted on said cleaning head.

15. A cleaning apparatus as defined in claim 1, wherein said cleaning head is of tetrafluoroethylene.

* * * * *